US006517268B1

(12) United States Patent
Omura et al.

(10) Patent No.: US 6,517,268 B1
(45) Date of Patent: Feb. 11, 2003

(54) PRINTER AND METHOD OF CONTROLLING IT

(75) Inventors: Kunio Omura, Shiojiri (JP); Kazuya Oshida, Hara-mura (JP); Naohiko Koakutsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 416 days.

(21) Appl. No.: 09/611,354

(22) Filed: Jul. 6, 2000

(30) Foreign Application Priority Data

Jul. 9, 1999 (JP) ..... 11-196606
May 24, 2000 (JP) ..... 2000-153278

(51) Int. Cl.[7] ..... B41J 33/388
(52) U.S. Cl. ..... 400/223; 400/225
(58) Field of Search ..... 400/223, 225

(56) References Cited

U.S. PATENT DOCUMENTS 4,213,715 A 7/1980 Haftmann et al.
4,373,438 A 2/1983 Arai

FOREIGN PATENT DOCUMENTS

EP 0 100 776 2/1984
JP 61-249783 11/1986
JP 63015779 1/1988
JP 02136276 5/1990
JP 3-95263 9/1991
JP 4-255384 9/1992

*Primary Examiner*—Andrew H. Hirshfeld
*Assistant Examiner*—Charles H. Nolan, Jr.
(74) *Attorney, Agent, or Firm*—Mark P. Watson

(57) ABSTRACT

A printer comprises a printing mechanism (9) composed of a platen (9*b*) and a printing head (9*c*) for printing on a recording medium (C, S) via an ink ribbon, a paper path (30, 33) for guiding the recording medium to and past said printing mechanism (9), the printing head (9*c*) and the platen (9*b*) being disposed facing each other on opposite sides of the paper path (30), an ink ribbon feeding device (9*e*, 9*d*) for transporting the ink ribbon between the printing head and the paper path (30), a medium transport mechanism (7, 91, 92) for transporting the recording medium (C, S) along the paper path (30, 33), a detecting device (6, 96) for detecting a predetermined position of said recording medium along the paper path (30, 33), and a controller (100) for controlling the ink ribbon feeding device (9*e*, 9*d*). The controller (100) causes the ink ribbon feeding device (9*e*, 9*d*) to transport the ink ribbon by a predetermined amount in response to an output signal from the detecting unit indicating that the recording medium is at the predetermined position.

8 Claims, 7 Drawing Sheets

PRINTER AND METHOD OF CONTROLLING IT

BACKGROUND OF THE INVENTION

1. Field of the Invention

The present invention relates to a printer for printing on a recording medium and to a method of controlling the printer (without imposing any restriction regarding the material of the recording medium it will hereinafter be referred to simply as "paper sheet").

2. Description of the Related Art

There is a kind of printing apparatus that is capable of printing predetermined characters on a paper sheet, such as a corporate or personal check, and is also capable of reading MICR (Magnetic Ink Character Recognition) characters recorded on the paper sheet. Conventionally, with such kind of apparatuses, the paper sheet is transported through a certain paper path and back-side printing (printing on the side of the paper sheet opposite to the side carrying MICR characters) is performed at an upstream side of the paper path, while front-side printing, based on the information read from the MICR characters, is performed thereon at a downstream side of the paper path.

For such back-side printing and front-side printing, dot impact type printing mechanisms are used that employ an ink ribbon supplied from an ink ribbon cartridge. A certain length of ink ribbon is exposed outside of the cartridge and extends between a printing head of the printing mechanism and the paper sheet. To always renew the exposed portion of the ink ribbon, an ink ribbon feeding device is controlled such that fresh ink ribbon is pulled out from one end of the cartridge while about the same length of used ink ribbon is returned at another end into the cartridge.

With such conventional apparatuses, problems result from the fact in that the frequency of back-side printing is far smaller than that of front-side printing, and the ink ribbon feeding devices are driven in accordance with their use. So, the same portion of the ink ribbon used for back-side printing remains exposed for long periods of time and tends to dry up, which results in printing defects.

JP-U-3-95263 describes a printer having an ink ribbon feeding device which is driven for a certain amount of time to feed the ink ribbon by a predetermined amount each time the printer is switched on. While this could solve the problem of dried ink ribbons in some cases, the primary use of the apparatus described above is for POS systems, where the power switch of the apparatus once turned on remains on all day. In such a case, there may be no opportunity for the ink ribbon to be sufficiently fed to the extent that drying of the exposed portion of the ink ribbon can be sufficiently prevented. This is even more true in shops operating on a 24-hour basis.

On the other hand, in case that some or all of the leading edge of the paper sheet is bent or curled, it may be caught by the ink ribbon as it moves past the printing head. If this occurs repeatedly, the ink ribbon may gradually loosen and eventually fall loose from the printing head.

OBJECTS OF THE INVENTION

It is an object of the present invention to provide a printer which prevents drying and loosening of an ink ribbon, so as to perform smoothly.

It is another object of the present invention to provide an improved printer suitable for POS systems.

SUMMARY OF THE INVENTION

In accordance with the present invention, the ink ribbon is fed by a certain amount each time or each predetermined number of times a paper sheet is detected at a predetermined position within the paper path. The certain amount is sufficient to prevent a degree of drying and loosening of the ink ribbon that could cause printing defects.

The present invention is particularly suitable for a printer comprising two separate printing mechanisms for front-side printing and back-side printing, respectively, as explained above. In this case, regardless of whether back-side printing is performed or not, the ink ribbon for back-side printing is wound up each time a paper sheet is processed in the printer. Thus, drying of the ink ribbon can be prevented even if back-side printing is not performed for long periods of time.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
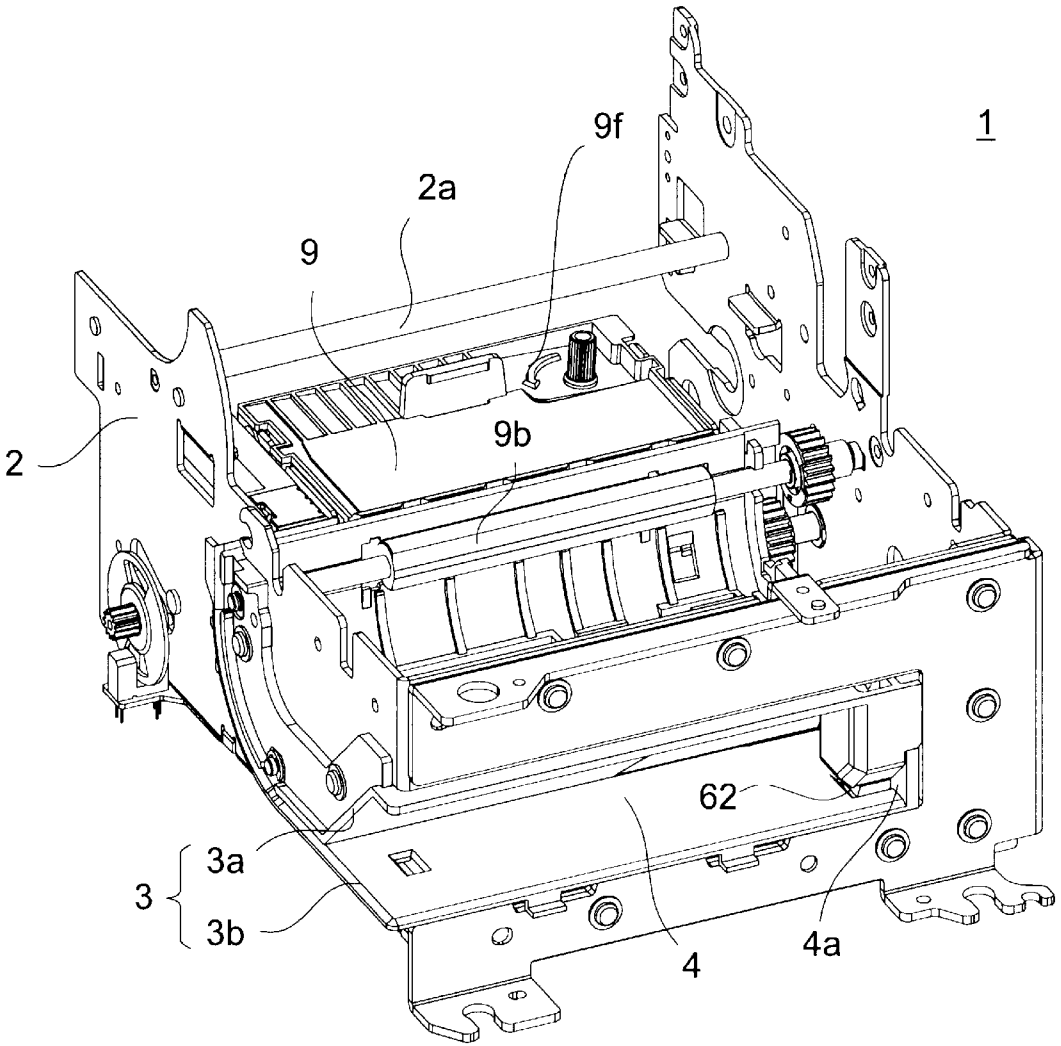
FIG. 1 is a perspective schematic view of a printer embodying the present invention.
Figure 2:
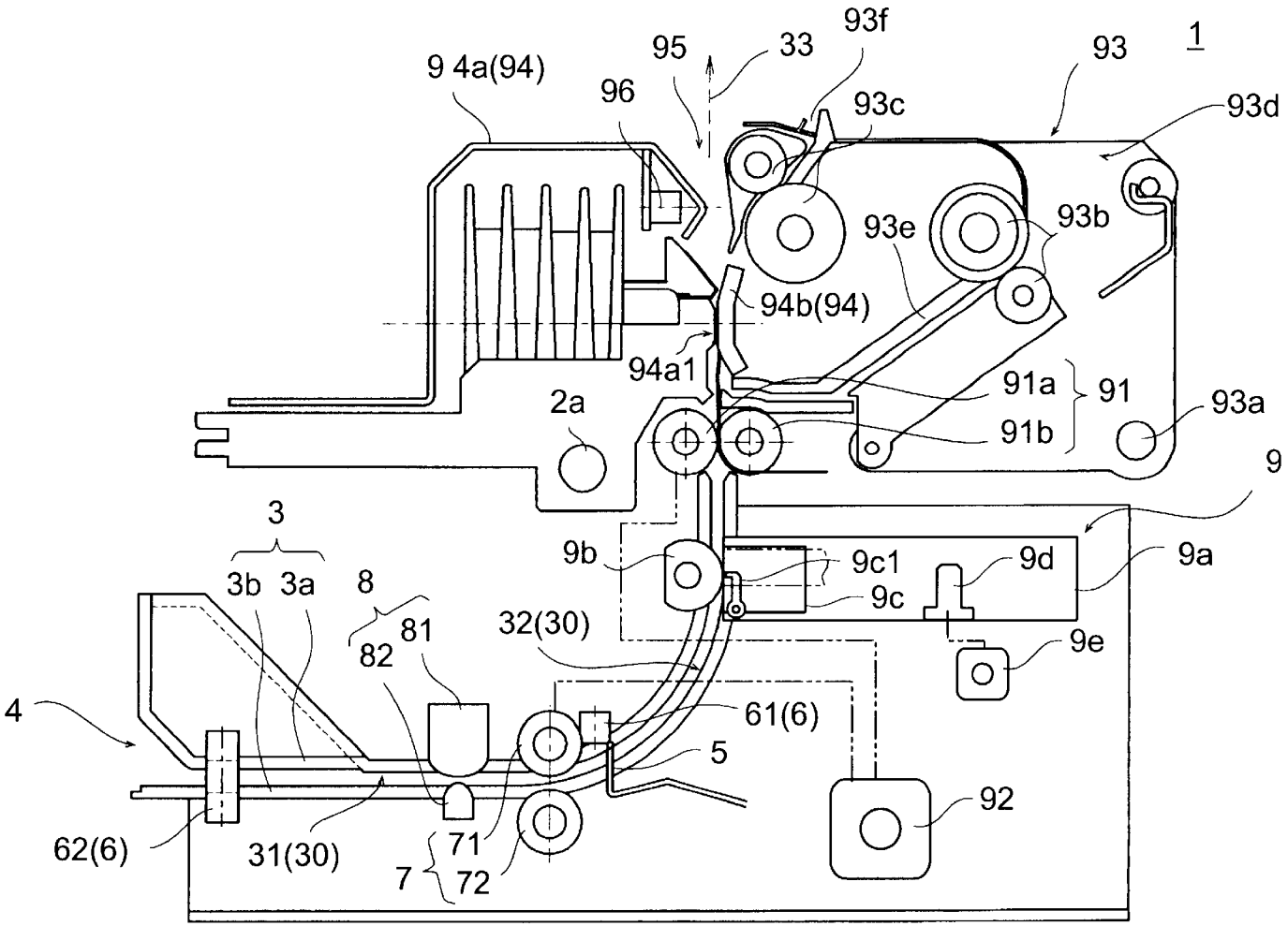
FIG. 2 is a schematic side view of the printer in FIG. 1.
Figure 3:
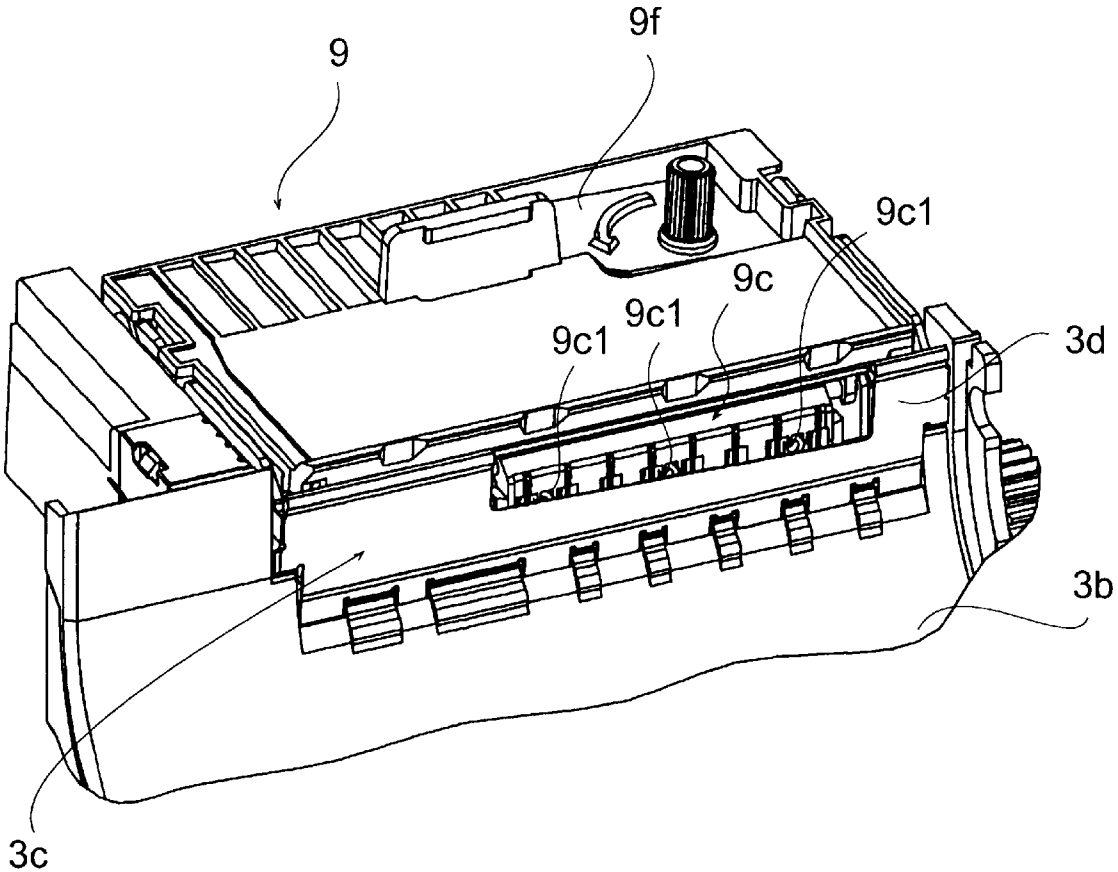
FIG. 3 is a perspective view illustrating a first printing mechanism in the printer of FIG. 1.

Referring to FIGS. 1 to 3, the structure of a printer embodying the present invention will be explained first. As shown in FIGS. 1 and 2, the printer 1 according to the present embodiment has a frame 2 made up of metal for example. A paper guide 3 formed of, e.g., resin or the like is attached to this frame 2. The paper guide 3 is made up of two guide members, i.e., an upper guide member 3*a* and a lower guide member 3*b*, with a certain spacing defined between the two guide members.

As shown in FIG. 2, the paper guide 3 extends from the front-side of the printer 1 (the left side in FIG. 2) toward the central part in a substantially horizontal direction, is then bent upward and extends further to the upper side of the frame 2 (top side in FIG. 2). Thus, a paper path 30 comprised of a straight first paper path section 31 and a curved second paper path section 32 is formed between the upper and lower guide members of the paper guide 3. In the present embodiment, the direction from the first paper path section 31 to the second paper path section 32 is referred to as the paper feeding direction, and the first paper path section 31 side is referred to as the upstream side of the paper path, and the second paper path section 32 side as its downstream side.

As shown in FIG. 1 and FIG. 2, an insertion opening 4 of a predetermined size for inserting a paper sheet into the paper guide 3 is formed at the front side of the printer. A paper stopper 5 is provided at about the middle of the paper guide 3. This paper stopper 5 is configured to move between a stopping position where it projects into the paper path 30 and a releasing position where it is retracted from the paper path. In its stopping position the paper stopper 5 retains a respective paper sheet in the first paper path section 31.

Figure 4:
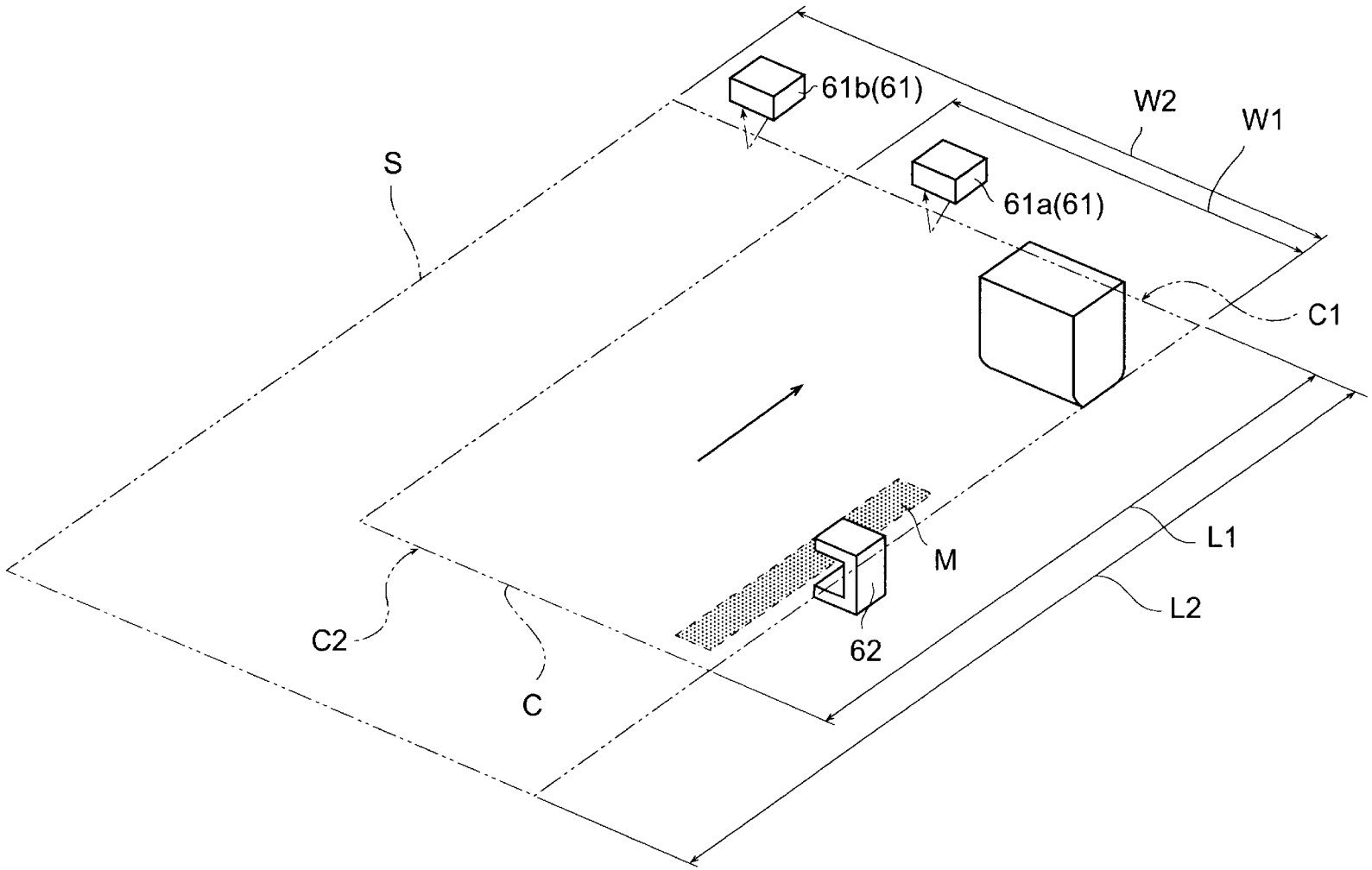
FIG. 4 is a diagram illustrating the positional relation between the paper detecting mechanism and the paper sheets.

One type of "paper sheet" that may be used with the present embodiment are checks C typically having a rectangular form of a standard size of width W1 and length L1 as shown in FIG. 4. MICR characters M are printed in a long band-like form along the edge at one longitudinal side of such check C (to the right side in FIG. 4). Hereafter, the following terms will be used in the description of the present embodiment: with a check C inserted into the insertion opening 4 with the MICR characters on the front side (facing up in FIG. 2), the edge of the check C which comes into contact with the paper stopper 5 will be referred to as the leading edge C1, and the opposite edge as the trailing edge C2.

Another type of "paper sheet" that may be used with the present embodiment are standard size document sheets S of width W2 (which is greater than W1) and length L2 (which is greater than L1).

As shown in FIGS. 2 and 4, the part of the paper guide 3 corresponding to the first paper path section 31 is provided with a paper detecting device 6. This paper detecting device 6 is formed of a photosensor arrangement comprising a sensor 61 for detecting the leading edge (hereinafter LE sensor) and a sensor 62 for detecting the trailing edge (hereinafter TE sensor) of a paper sheet, such as the check C and the document sheet S mentioned above.

The LE sensor 61 is positioned near the paper stopper 5 on the upstream thereof. Thus, the LE sensor 61 can detect a paper sheet (C or S) which has its leading edge (C1 in case of check C) abutting against the paper stopper 5.

In the present embodiment, the LE sensor 61 is made up of a first LE sensor element 61*a* and a second LE sensor element 61*b* shown to the right and to the left in FIG. 4, respectively. These two sensor elements are disposed on a line extending in a direction substantially perpendicular to the paper feeding direction. The first LE sensor element 61*a* is disposed at a position within the width W1 of the check C from a paper edge guide (4*a* in FIG. 1) for one of the longitudinal edges of the paper sheet. The second LE sensor element 61*b* is located beyond the width WI but within the width W2 of the document sheet S from the paper edge guide 4*a*.

On the other hand, the TE sensor 62 is positioned near the insertion opening 4 on the side of the paper edge guide 4*a* so that the above mentioned one longitudinal edge of a paper sheet (that one along which MICR characters M are arranged in case of a check C) can be detected. The distance between TE sensor 62 and LE sensor 61, measured along the paper path parallel to the paper feeding direction, is shorter than the length L1 of the check C.

The portion of the paper guide 3 corresponding to the first paper path section 31 is provided with a first paper feeding device 7. This first paper feeding device 7 is configured of a pair of rollers, a driving roller 71 and a driven roller 72. The driving roller 71 is positioned, in close proximity to the LE sensor 61, on the insertion opening side of the LE sensor 61 and on the upper guide member side of the paper guide 3. The driven roller 72 is positioned at the lower guide member side of the paper guide 3 so as to be movable between a position in contact and a position out of contact with the driving roller 71. The driving roller 71 is driven via a gear train (not shown) by means of a driving motor 92 in the form of a stepping motor.

As shown in FIG. 2, a magnetic reading device 8 for reading the MICR characters M is provided at the first paper path section 31. This reading device 8 comprises a reading head 81 and a pressing member 82. The reading head 81 is positioned on the upper guide member side and near to the driving roller 71 on the side of the insertion opening 4. The head pressing member 82 is positioned on the lower guide member side and is movable between two positions so as to either press against or be spaced apart from the reading head 81. Incidentally, a magnetizing member (not shown) for magnetizing the MICR characters M is provided on the upstream side of the magnetic reading device 8.

As shown in FIG. 1 and FIG. 2, a first printing mechanism 9 for back-side printing is provided at a position of the second paper path section 32. This first printing mechanism 9 comprises a printing unit 9*a* and a platen 9*b*. The printing unit 9*a* is at a predetermined position on the lower guide member side. For this first printing mechanism 9 a mechanism such as that described in U.S. Pat. No. 4,373,438 may be used.

The printing unit 9*a* comprises a dot-impact type printing head 9*c* that has a plurality of movable printing elements 9*c*1 arrayed in the widthwise direction of the paper sheet and that is configured such that the printing elements 9*c*1 project slightly into the second paper path section 32.

FIG. 3 is a perspective view showing the first printing mechanism of FIG. 1 with the platen 9*b* and the guide member 3*a* removed. As shown in FIG. 3, at the portion where the printing unit 9*a* is provided, an opening 3*c* is formed in the lower guide member 3*b* such that the printing head 9*c* is exposed to the second paper path section 32. An ink ribbon guide 3*d* is provided so as to cover the area of the printing unit facing the paper path other than the portion where the printing elements 9*c*1 are provided and the area surrounding them. A first ink ribbon (ink ribbon for back-side printing) supplied from an ink ribbon cartridge 9*f* is inserted between the printing head 9*c* and the ribbon guide 3*d*, and is transported along the ribbon guide 3*d* when a ribbon motor 9*e* (FIG. 2), such as a stepping motor or a DC motor, is driven.

As shown in FIG. 2, a take-up shaft 9*d* capable of engaging a reel portion of the ink ribbon cartridge 9*f* is provided at the rear part of the printing unit 9*a*. This take-up shaft 9*d* is adapted to wind up the ink ribbon within the ink ribbon cartridge 9*f* when it is driven by the ribbon motor 9*e*. When an ink ribbon cartridge 9*f* is mounted in the printing unit 9*a*, part of the ink ribbon is exposed from the ribbon cartridge 9*f* and is positioned with a predetermined tension between the printing head 9*c* and the ribbon guide 3*d*.

The platen 9*b* is positioned on the upper guide member side at a certain spacing to the printing head 9*c*. This platen 9*b* has a so-called D-cut cross-section and can rotate to change the position of the D-cut (flattened) portion. An inserted paper sheet C or S is allowed to pass through when the D-cut portion is positioned to face the printing head 9*c*. In contrast to this, the paper sheet is allowed to be printed when the D-cut portion faces away from the printing head 9*c*.

A second paper feeding device 91 is provided next to the downstream end of the paper guide 3. This second paper feeding device 91 comprises a pair of rollers, namely a driving roller 91*a* and a driven roller 91*b*. Note that the distance between the first paper feeding device 7 and the second paper feeding device 91, measured along the paper path 30, is shorter than the length L1 of a check C. The driving roller 91*a* is driven via a gear train by the driving motor 92, so as to rotate together with the driving roller 71.

A receipt transport mechanism 93 and a second printing mechanism 94 for front-side printing are provided in an upper part of the frame 2. The printing mechanism 94 comprises a printing unit 94*a* and a platen 94*b* facing each other across a third paper path section 33 contiguous to the upper end of the paper path 30. The printing unit 94*a* is supported by a shaft 2*a* fixed to the frame 2 to be able to reciprocate in the paper width direction (perpendicular to the drawing plane of FIG. 2).

On its side facing the paper path section 33 the printing unit 94*a* has an impact type printing head 94*a*1 with multiple dot wires arrayed in the paper feeding direction. Printing is performed by letting the dot wires press a second ink ribbon (ink ribbon for front-side printing, not shown) onto the surface of a respective paper sheet C or S backed by the platen 94*b*.

The receipt transport mechanism 93 comprises a feed roller pair 93*b* and a discharge roller pair 93*c*. Roll paper (not shown) is inserted into an insertion opening 93*d*, passes though a roll paper path 93*e* to the paper path section 33 and past the platen 94*b* and is subsequently discharged from a discharge opening 93*f*. Printing is performed on the portion of the roll paper positioned between the platen 94*b* and the printing head 94*a*1. That is to say, the printing head 94*a*1 used for front-side printing on paper sheets C and S is also used for printing the receipts on roll paper. The printed roll paper is cut to an appropriate length by an auto-cutter (not shown), and discharged from the discharge opening 93*f*. Incidentally, the receipt transport mechanism 93, the platen 94*b* and the roller 91*b* are mounted on a sub-frame pivotally supported at the back-side of the frame 2 by means of a supporting shaft 93*a*. The paper path section 33 can be opened by turning this sub-frame clockwise as viewed in FIG. 2.

A paper discharge opening 95 for paper sheets C and S is formed at the downstream side of the second printing mechanism 94, i.e., at the downstream end of the paper path section 33. A sensor 96 for detecting discharge of a paper sheet (hereinafter PD sensor) is provided at a position of the paper path section 33 between the printing head 94*a*1 and the paper discharge opening 95. This PD sensor 96 is a photosensor adapted to detect a paper sheet C or S as it passes through the paper discharge opening 95 of the paper path section 33.

Although not shown in the present embodiment, a discharge roller pair may be provided near the paper discharge opening 95 similar to the roller pair 93*c* of the receipt transport mechanism.

Figure 5:
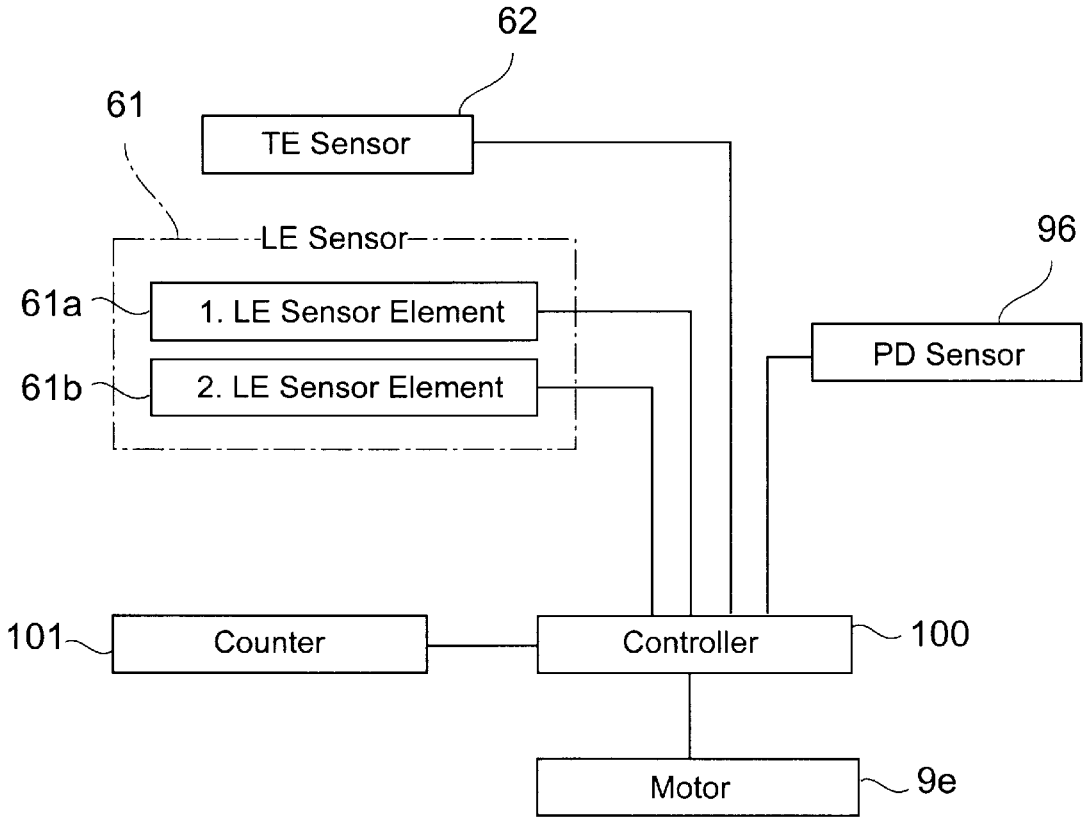
FIG. 5 is a block diagram of a control system for the printer in FIG. 1.
Figure 6:
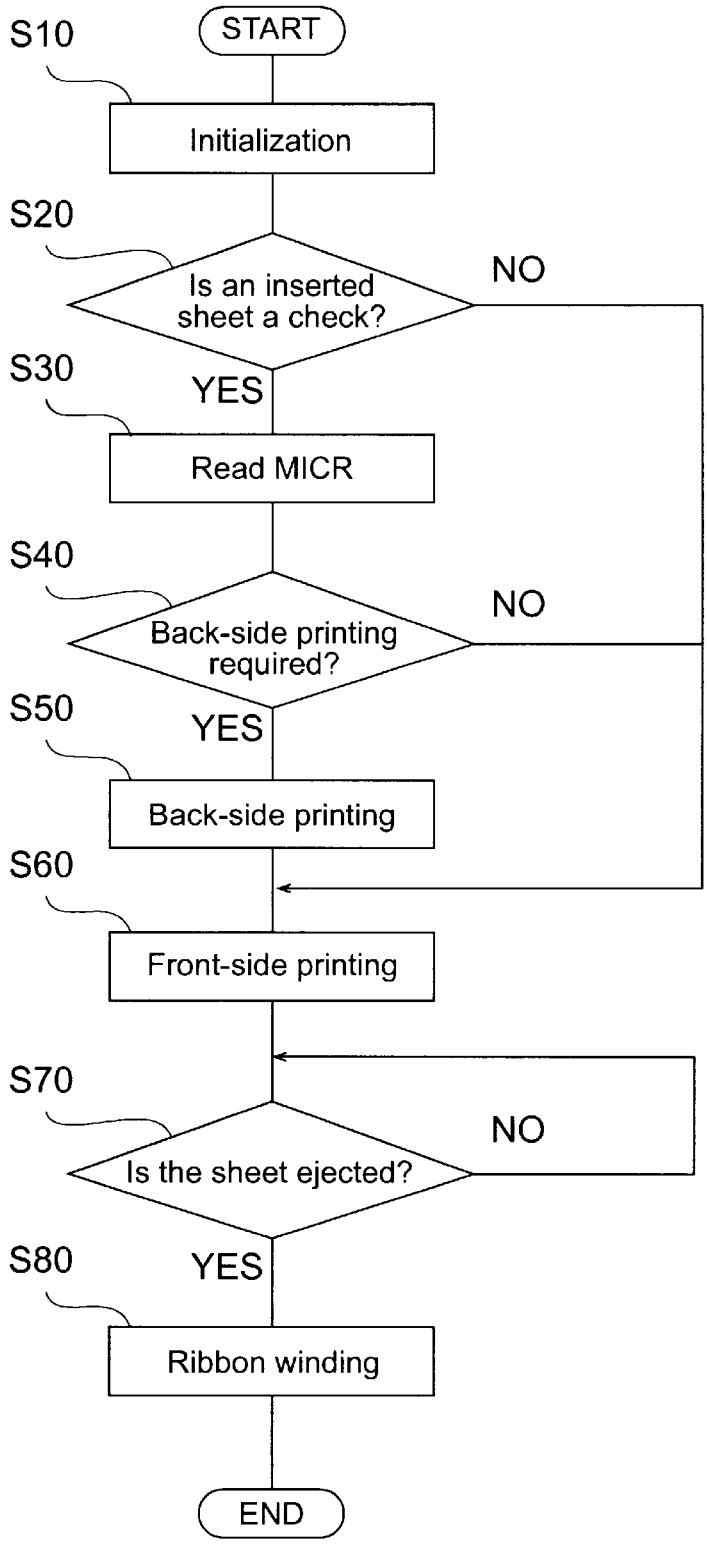
FIG. 6 is a flowchart of a control process according to an embodiment of the invention.

FIG. 5 is a block diagram illustrating a control system for controlling the present embodiment. FIG. 6 is a flowchart illustrating the control process according to the present embodiment.

As shown in FIG. 5, the printer 1 has a controller 100 for controlling, among others, the ribbon motor 9*e* used for feeding the first ink ribbon of the back-side printing mechanism 9. This controller 100 is electrically connected to the LE sensor 61 (61*a*, 61*b*) and the TE sensor 62 of the paper detecting device 6, the PD sensor 96, and the ribbon motor 9*e*, and controls the ribbon motor 9*e* based on the signals from the PD sensor 96, the LE sensor 61 and the TE sensor 62.

The controller 100 is also electrically connected to a counter 101 for counting the transport amount of a respective paper sheet C/S. Further, controller 100 is electrically connected to a solenoid (not shown) for moving the paper stopper 5, to the reading head 81, to the driving motor 92, and so forth.

The following is a description of the control process as performed by the controller 100 according to the embodiment shown in FIG. 6, making reference to FIGS. 2 and 4 as necessary, along with the operation of the printer 1.

First, in step S10 shown in FIG. 6, along with a certain initializing process for the printer 1 performed at the time of turning the power on, the controller 100 causes the ribbon motor 9*e* to rotate by a predetermined amount to wind up the ribbon.

With an application program running on a host computer, to which the printer 1 is connected, the operator then enters instructions and data for processing a check C or a simple document sheet S by the printer 1. The operator also inserts a corresponding paper sheet, either a check C or a document sheet S, into the insertion opening 4 of the printer 1, such that one of the longitudinal edges of the paper sheet is guided by the paper edge guide 4*a* and until the leading edge abuts against the paper stopper 5.

The host sequentially transmits commands and data corresponding to the processing, which the user has instructed, to the printer 1, and the printer 1 performs the following process.

In step S20, based on signals from the LE sensor 61 and the TE sensor 62, the controller 100 recognizes whether or not the leading edge and the (guided) longitudinal edge of the recording paper are in the predetermined positions, and also recognizes whether the inserted paper sheet is a check C or a document sheet S.

If processing of a document sheet S has been instructed and detection signals are received from the first LE sensor element 61*a*, the second LE sensor element 61*b*, and the TE sensor 62, the controller 100 recognizes that a document sheet S has been inserted into the appropriate position, and the process flow advances to step S60.

If processing of a check C has been instructed and detection signals are received from the first LE sensor element 61*a* and the TE sensor 62 while none is received from the second LE sensor element 61*b*, the controller 100 recognizes that a check C has been inserted into the appropriate position, and the process flow proceeds to step S30.

Before the process flow proceeds from step S20 to either step S30 or step S60, first, by a command from the controller 100, the paper stopper 5 is retracted from the paper path 30, following which the driving motor 92 starts driving the first paper feeding device 7 with the check C or document sheet S pressed between the driving roller 71 and the driven roller 72; this feeds the check C or document sheet S in the paper feeding direction.

At step S30, the following MICR process is performed. Along with the feeding of the check C, the controller 100 causes the reading head 81 to read the MICR characters M magnetized by the magnetizing member. The information read by the reading head 81 is entered into the controller and the process flow proceeds to step S40.

At step S40, based on the commands received from the host, the controller 100 judges whether or not back-side printing is necessary; if it is necessary, the process flow proceeds to step S50 while, if it is not necessary, the process flow skips step S50 and proceeds to step S60.

In step S50 the controller 100 performs the back-side printing on the check C using the first printing mechanism 9. Back-side printing is performed in accordance with the commands and data received from the host. Here, the printing head 9*c* of the printing mechanism 9 strikes printing elements 9*c*1 against the check C with the first ink ribbon in between, thereby forming an image composed of ink dots. In this case, the position on the check at which the printing head 9*c* is to start printing, is determined by the count value of the counter 101 counting the drive pulses to the driving motor 92. During this back-side printing the ribbon motor 9*e* is also driven to wind up the first ink ribbon in the ribbon cartridge 9*f* by means of the take-up shaft 9*d*. When back-side printing is finished, the process flow proceeds to step S60.

At step S60 the controller 100 causes the second printing mechanism 94 to perform front-side printing on either a check C or, when the process flow jumped to step S60 from step S20, a document sheet S. Front-side printing is performed in accordance with commands and data received from the host and, in case of a check, in accordance with information represented by the MICR characters.

In the following step S70 the controller 100 waits for the detection signal from PD sensor 96 indicating that the paper sheet, check C or document sheet S, has been ejected from the paper discharge opening 95. When this happened the process flow proceeds to step S80. The controller 100 may be arranged to delay transition to step S80 for a certain time from the moment the PD sensor 96 issued the detection signal, if there is some distance between the PD sensor 96 and the paper discharge opening 95.

Then, in step S80, the controller 100 causes the ribbon motor 9*e* to start and wind up the first ink ribbon in the ribbon cartridge 9*f* by a predetermined amount. Thus, according to the present embodiment, regardless of whether back-side printing is performed or not, the first ink ribbon is wound up each time all printing on a paper sheet C or S is completed; even if the leading edge of a paper sheet is caught by the first ink ribbon and loosens it, the ink ribbon is immediately wound up and prevented from coming too loose.

Further, according to the present embodiment, the winding process of the first ink ribbon is performed following discharge of the respective paper sheet, so troubles in other devices owing to the winding process can be avoided. For example, the magnetic head 81, while reading MICR characters M, can be prevented from picking up electric and or magnetic noise generated by the ribbon motor 9*e*.

Incidentally, in the above embodiment, the first ink ribbon is wound up each time a paper sheet has been ejected, regardless of whether back-side printing was performed or not. Alternatively, the arrangement may be such that the first ink ribbon is wound up in response to ejection of a paper sheet only if this paper sheet was not subjected to back-side printing. Referring to FIG. 6 this means that whenever step S50 has been executed step S80 is skipped. This arrangement is advantageous in that unnecessary ink ribbon winding in step S80 is avoided when ink ribbon winding has already been performed as part of the back-side printing process.

As another alternative to the embodiment described above, instead of employing the PD sensor 96 for detecting ejection of a paper sheet, the count value of the counter 101 may be used. That is to say, the arrangement may be such that the winding process for the first ink ribbon is performed when the count value of the counter 101 corresponds to the length of the paper path from the position of the paper stopper 5 to the paper discharge opening 95. When the count value of the counter 101 corresponds to this length, the driving motor has been driven by the number of drive pulses necessary to transport a paper sheet from the initial position where its leading edge abuts against the paper stopper 5 to the position where the leading edge of the paper sheet has reached the discharge opening 95. It will be appreciated that the count value that is taken as a ejection detection signal need not exactly correspond to the above mentioned length; in particular, the count value may be a bit greater. With this alternative, the PD sensor 96 can be omitted.

As still another alternative, the arrangement may be such that a sensor like the PD sensor 96 is provided at a predetermined position along the paper path sections 32 and 33, and another counter, similar to counter 101, is made to start counting the transport amount of a respective paper sheet (in the form of drive pulses to the driving motor 92) upon that sensor detecting the paper sheet. In such case the ink ribbon winding process is performed when the count value of the counter 101 reaches a value corresponding to the length of the paper path from the position of that sensor to the paper discharge opening 95.

Hence, while there are several alternatives for the event in response to which the ribbon winding in step S80 is performed, directly detecting the paper sheet C or S passing through the paper discharge opening 95 with the PD sensor as described above is advantageous in that it allows the simplest form of the controller 100 whether implemented by hardware or software. It is to be noted that each of these alternatives for step S80 may be combined with the described alternative of skipping step S80 when step S50 is executed.

Figure 7:
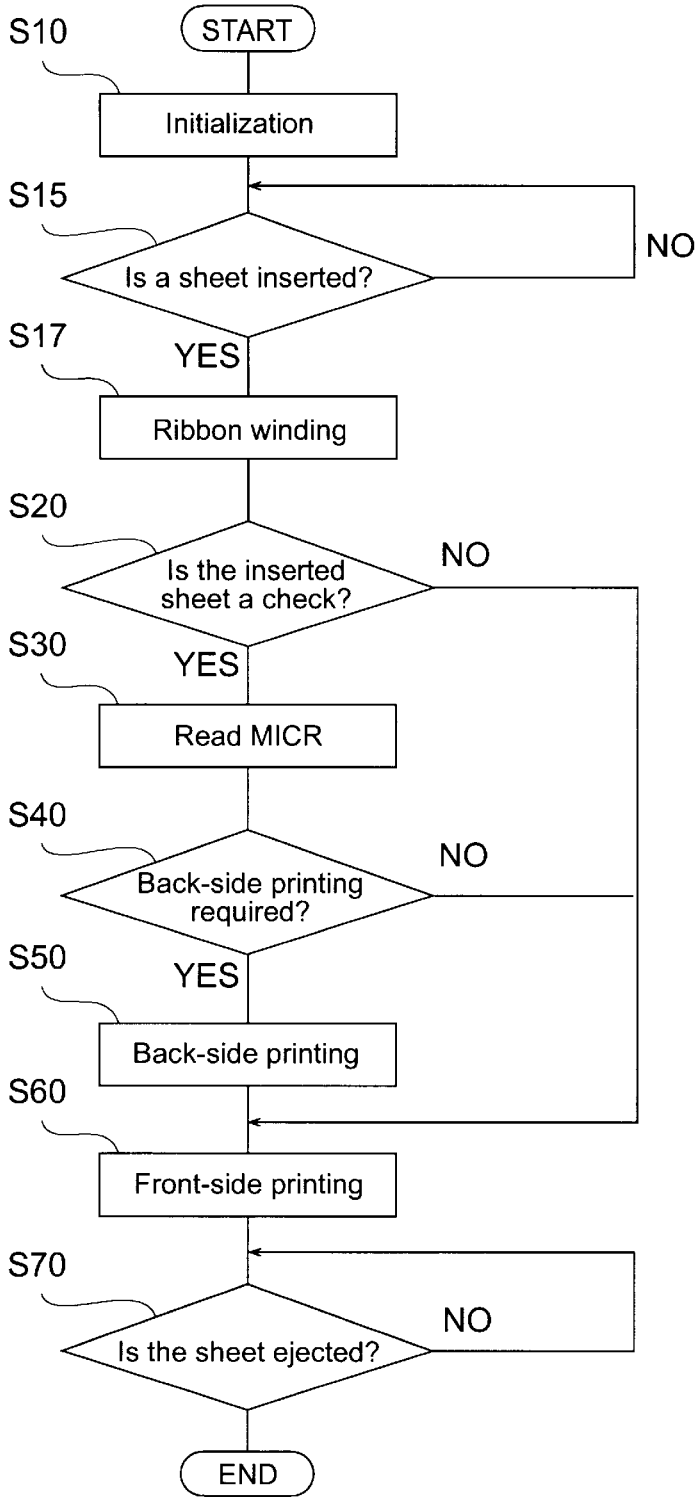
FIG. 7 is a flowchart of a modification of the control process of FIG. 6.

FIG. 7 is a flowchart illustrating a modification of the control process described above. Steps S10 and S20 to S70 are the same as in FIG. 6. Step S80 in FIG. 6 is substituted by steps S15 and S17 in FIG. 7. This means that according to FIG. 7 the ink ribbon winding process is performed in response to a paper sheet being inserted, whereas with in FIG. 6 the ink ribbon winding process is performed in response to a paper sheet being ejected.

In FIG. 7, following the initialization in step S10, the process flow waits for insertion of paper sheet (step S15). When the operator inserts a paper sheet, either a check C or document sheet S, into the insertion opening 4 of the printer 1, detection signals are input to the controller 100 from the LE sensor 61 and the TE sensor 62. Regardless of the type of paper sheet, these detection signals cause the controller 100 to drive the ribbon motor 9*e* to wind up the first ink ribbon by a predetermined amount (step S17).

The following steps S20 to S70 are performed or skipped based on commands and data received from the host computer as explained in detail in the context of FIG. 6.

Note that the present invention is by no means restricted to the above embodiments, and that various alterations may be made.

In the embodiments explained above the controller 100 obtains information regarding the type of the inserted paper sheet from signals received from the paper detecting device 6, and recognizes whether or not back-side printing is necessary based on commands and data received from the host computer. However, the present invention is not restricted to this and may use an operating panel (not shown) for manual input of such information by the operator.

For example, regarding the flow charts in FIGS. 6 and 7, if back-side printing on a check is instructed via the operating panel, the process flow proceeds to step S50 following step S30. If only front-side printing on a check is instructed via the operating panel, the process flow skips step S50 and proceeds to step S60 from step S30. If front-side printing on a document sheet is instructed via the operating panel, the process flow proceeds to step S60 from step S20.

Further, the above embodiments carry out the ink ribbon winding process each time a certain event occurs, namely (1) a paper sheet is inserted (FIG. 7 embodiment), (2) a paper sheet is ejected (FIG. 6 embodiment) or (3) a paper sheet is ejected without having been subjected to back-side printing (modification of FIG. 6 embodiment). Alternatively, depending on the frequency of use of the front-side printing, the arrangement may be such that the ink ribbon winding process is conducted each time a predetermined number of event (1), (2) or (3), respectively, occurred.

Further, although the above embodiments relate to a printer which has both a printing mechanism 94 for front-side printing and a printing mechanism 9 for back-side printing, the present invention is also applicable to a printer which performs printing only on one side of a paper sheet, so long it a dot-impact type printer which has an ink ribbon feeding device.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printer comprising:

a printing mechanism comprising a platen and a printing head for printing on a recording medium with an ink ribbon, a paper path for guiding the recording medium to and past said printing mechanism, the printing head and the platen being disposed facing each other on opposite sides of the paper path, an ink ribbon feeding device for transporting said ink ribbon to and past a space between said printing head and said paper path, a medium transport mechanism for transporting said recording medium along said paper path, a detecting unit for detecting a predetermined position of said recording medium along said paper path, and a controller for controlling said ink ribbon feeding device, said controller causing said ink ribbon feeding device to transport said ink ribbon by a predetermined amount in response to an output signal from said detecting unit indicating that said recording medium is at said predetermined position.

2. A printer according to claim 1, wherein said printing mechanism comprises a first printing mechanism unit that prints on a first side of said recording medium, and a second printing mechanism unit that prints on the opposite second side of the recording medium.

3. A printer according to claim 1, further comprising a reading head for reading information magnetically recorded on said recording medium.

4. A printer according to claim 1, wherein said paper path has an insertion opening through which a recording medium to be printed can be inserted into the paper path, and a discharge opening through which a recording medium can be discharged from the paper path after printing, and said predetermined position of the recording medium is at least one of a position at or near to said discharge opening and a position at or near to said insertion opening.

5. A printer according to claim 1, wherein said detecting unit comprises a counter for counting the transport amount of said recording medium along said paper path, said controller using the count value of said counter to determine whether or not the recording medium is at said predetermined position.

6. A method of controlling a printer having a printing head for printing on a recording medium with an ink ribbon, said method comprising the following steps:

(a) transporting a recording medium inserted into the printer to a printing position, (b) printing on the recording medium at said printing position and subsequently discharging the recording medium from the printer, (c) detecting at least one of insertion of a recording medium into the printer and discharge of a recording medium from the printer, and (d) transporting said ink ribbon by a predetermined amount in response to the detection in step (c).

7. A method according to claim 6, said printer comprising a printing mechanism including a first printing mechanism unit that prints on a first side of said recording medium, and a second printing mechanism unit that prints on the opposite second side of the recording medium, wherein step (a) comprises:

(a1) reading, during said transporting of the recording medium, information magnetically recorded on the recording medium, if any, step (b) comprises:

(b1) deciding whether printing on a first side of said recording medium is necessary and, if so, printing on said first side with said first printing mechanism, unit and (b2) printing on the opposite second side of said recording medium with said second printing mechanism, and wherein the ink ribbon transported in step (d) is the ink ribbon of said first printing mechanism.

8. A method according to claim 7, wherein step (c) is omitted if printing is performed in step (b1).

* * * * *